US006334419B1

(12) United States Patent
Shomura et al.

(10) Patent No.: US 6,334,419 B1
(45) Date of Patent: Jan. 1, 2002

(54) OUTBOARD MOTOR

(75) Inventors: Nobuyuki Shomura; Yukihiro Yoshikawa; Kazuo Mineno; Naoki Kawasaki, all of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/570,175

(22) Filed: May 12, 2000

(30) Foreign Application Priority Data

May 12, 1999 (JP) ..... 11-131925

(51) Int. Cl.[7] ..... F02F 7/00
(52) U.S. Cl. ..... 123/195 P; 123/41.82 R
(58) Field of Search ..... 123/195 P, 195 C, 123/195 E, 196 W, 634, 635, 647, 309, 41.82 R; 440/900

(56) References Cited

U.S. PATENT DOCUMENTS 4,452,194 A * 6/1984 Watanabe ..... 123/195 P
5,501,188 A * 3/1996 Fukuoka ..... 123/179.25
5,694,895 A * 12/1997 Tsunoda et al. ..... 123/179.24
5,829,402 A * 11/1998 Takahashi et al. ..... 123/184.24
5,878,726 A * 3/1999 Takahashi et al. ..... 123/516
5,908,338 A * 6/1999 Kawasaki et al. ..... 440/89
5,984,742 A * 11/1999 Kimura et al. ..... 440/77
6,186,844 B1 * 2/2001 Yonezawa et al. ..... 440/52

FOREIGN PATENT DOCUMENTS

JP 32998 * 2/1991
JP 47221 * 2/1998

* cited by examiner

*Primary Examiner*—Willis R. Wolfe
*Assistant Examiner*—Hai H. Huynh
(74) *Attorney, Agent, or Firm*—Oblon, Spivak, McClelland, Maier & Neustadt, P.C.

(57) ABSTRACT

An outboard motor generally comprises an engine holder, an engine disposed above the engine holder, an oil pan disposed below the engine holder, and an engine cover covering the engine holder, the engine and the oil pan so as to define a space between the engine and the engine cover. The engine includes a crankcase in which a crankshaft extends vertically perpendicularly in a usable state of the outboard motor, a cylinder block disposed rear side of the crankcase, a cylinder head disposed rear side of the cylinder block, an intake unit disposed to one surface side of the engine, an exhaust unit disposed to another one surface side thereof and arranged so as to project outward from the another one surface side of the engine as an exhaust projection portion, and an electrical equipment part. The above-mentioned space between the engine and the engine cover includes a space portion defined by the cylinder head, the exhaust projection portion and the engine cover and the electrical equipment part is disposed in this space portion.

5 Claims, 7 Drawing Sheets

OUTBOARD MOTOR

BACKGROUND OF THE INVENTION

1. Field of the Invention

The present invention relates to an outboard motor and, more particularly, to an outboard motor having an improved layout or structure of electrical equipments or parts of an engine thereof.

2. Prior Art

In general, an engine mounted to an outboard motor has a structure in which a crankshaft is vertically perpendicularly extends, in a usable state such as mounted to a hull, for example, and which employs an engine layout in which intake system parts are disposed on one side surface of the engine and exhaust (system) parts are disposed on the other side surface of the engine. The exhaust system parts includes an exhaust cover for closing an exhaust manifold or an exhaust passage projecting sideways of the engine, and such an exhaust system projecting portion constitutes a portion of the engine having the maximum width in the engine lateral direction.

Further, this projecting portion is extended in a vertical direction at substantially central portion of the side surface of the engine, and an electrical equipment box, in which a control (system) electrical equipment is accommodated, is disposed in an engine side surface space in front of the projecting portion.

Prior art provides a structure in which electric equipment comprising an ignition coil, a rectifier and a regulator is disposed in the above-described space and a structure in which the electrical equipment is disposed to the engine exhaust projecting portion itself, such as disclosed in Japanese Patent Laid-open Publication No.7-77140, Japanese Patent Laid-open Publication No.8-100671, Japanese Patent Laid-open Publication No.10-47221, Japanese Patent Laid-open Publication No.10-157693.

Meanwhile, a four-stroke-cycle engine mounted in the outboard motor has an engine temperature higher than that of a two-stroke-cycle engine. Therefore, in order to protect the electrical equipment from being suffered from the harmful heat of the engine, prior art also provides an example in which the electrical equipment is disposed in a lower portion of a flywheel to cool the electrical equipment by a wind generated by the flywheel, such as disclosed in Japanese Patent Laid-open Publication No.8-100645 and also provides an example in which the electrical equipment is mounted in a lid member of a cooling water passage provided in the exhaust passage in the projecting portion, such as disclosed in the Japanese Patent Laid-open Publication No.8-100671.

However, if the electrical equipment is disposed in the projecting portion of the exhaust system parts, the lateral width of the engine is further increased, and a cover for covering the engine is hence increased in size, which is disadvantageous for reducing the outboard motor both in size and weight.

On the other hand, if an ignition coil is disposed in the engine side surface space forward of the projection, a high-tension cord, which connects the ignition coil and an ignition plug disposed in an engine side surface space rearward of the projecting portion, straddles the projecting portion, which elongates the high-tension cord, and nose is prone to be generated.

Furthermore, it is necessary to provide a clearance between the projecting portion and the high-tension cord to prevent them from coming into contact with each other and the lateral width of the engine is adversely increased.

Further, when the ignition coil is disposed near the electrical equipment box in which the controlling electrical equipment is accommodated, a noise resistance of the control system electrical equipment must be enhanced, which will increases a manufacturing cost.

On the other hand, in an arrangement in which the flywheel cools the electrical equipment, it is absolutely necessary to increase the flywheel in size, and since a place where the electrical equipment is disposed is limited, and the flexibility of layout will be deteriorated.

SUMMARY OF THE INVENTION

The present invention has been accomplished in view of the above circumstances, and it is an object of the invention to provide an outboard motor having an improved structure of an electrical equipment arrangement in consideration of the compact size, reduction of noise and effective cooling ability.

This and other objects can be achieved according to the present invention by providing an outboard motor comprising:

- an engine holder;
- an engine disposed above the engine holder in a mounted usable state of the outboard motor;
- an oil pan disposed below the engine holder; and
- an engine cover covering the engine holder, the engine and the oil pan so as to define a space between the engine and the engine cover, said engine comprising:

- a crankcase in which a crankshaft extends vertically perpendicularly;
- a cylinder block disposed rear side of the crankcase;
- a cylinder head disposed rear side of the cylinder block;
- an intake unit disposed to one surface side of the engine;
- an exhaust unit disposed to another one surface side thereof, said exhaust system part being arranged so as to project outward from the another one surface side of the engine as an exhaust projection portion; and
- an electrical equipment part,
- wherein the space between the engine and the engine cover includes a space portion defined by the cylinder head, the exhaust projection portion and the engine cover and the electrical equipment part is disposed in the space portion.

In a preferred embodiment, an ignition plug is disposed to the cylinder head so as to define the space portion between the ignition plug and the exhaust projection portion between which ignition coil means is arranged. The ignition coil means is disposed in a vertical direction, the ignition plug includes a plug cap which is connected to the ignition coil means through a high-tension cord so that a connected portion between the ignition coil and the high-tension cord and a connected portion between the plug cap and the high-tension cord are disposed in a rear and obliquely downward direction.

A boss or bosses for mounting the electrical equipment part are integrally formed to the cylinder head, and a cooling water jacket is formed to the cylinder head in the vicinity of the boss.

The engine cover includes upper and lower cover sections in the vertical usable state of the outboard motor and the electrical equipment part including an element generating a heat, the electrical equipment element generating the heat being located below a dividing portion of the engine cover.

As explained above, according to the structure for mounting electrical equipment of the outboard motor of the present invention, the an intake system part is disposed on one side surface of an engine, comprising a cylinder head to which an ignition plug is mounted, a cylinder block and the like, and an exhaust system part is disposed on the other side surface of the engine, the exhaust system part project sideways of the engine to form the exhaust system projecting portion. The electrical equipment system part is disposed in the space between the ignition plug and the projecting portion on a side surface closer to the cylinder head. Therefore, the dead space can be utilized effectively, and the outboard motor can be made compact.

Further, since a plurality of ignition coils are disposed between the ignition plug and the projecting portion in the space formed on the side surface closer to the cylinder head, the noise is reduced, and the maintenance is facilitated.

Further, the plurality of ignition coils are disposed in a vertical direction, a plug cap of the ignition plug and the ignition coils are connected to each other through a high-tension cord, a connected portion between the ignition coil and the high-tension cord, and a connected portion between the plug cap and the high-tension cord are disposed in a rear and downward oblique direction. Therefore, attaching/detaching (mounting) performance of the ignition plug and the plug cap can be enhanced and the waterdrop is less prone to reach these connected portions.

Furthermore, since a boss for mounting the electrical equipment system part is integrally formed on the cylinder head, and a contact surface of the boss contacting with the electrical equipment system part is set as wide as possible, it is possible to prevent the electrical equipment part from being heated.

Further, since a cooling water jacket is disposed in the vicinity of the boss, it is possible to prevent the electrical equipment part from being heated.

Furthermore, a periphery of the engine is covered with an engine cover which can be divided into upper and lower two cover sections, some electrical equipment system parts such as regulator which generate great heat are disposed below a dividing surface of the engine cover and a gap between the electrical equipment system part and the engine cover is hence made small. Therefore, it is possible to reduce the number of parts.

Furthermore, since the electrical equipments, such as rectifier and regulator, which generate much heat, are arranged below the divided section of the engine cover so as to reduce a gap between it and the lower cover section, the possibility for a user to contact the electrical equipments can be prevented and, hence, no contact prevention cover or no display label will be needed.

The nature and further characteristic features of the present invention will be made clear from the following descriptions made with reference to the accompanying drawings.

DESCRIPTION OF THE PREFERRED EMBODIMENTS

One embodiment of the present invention will be described hereunder with reference to the accompanying drawings.

Figure 1:
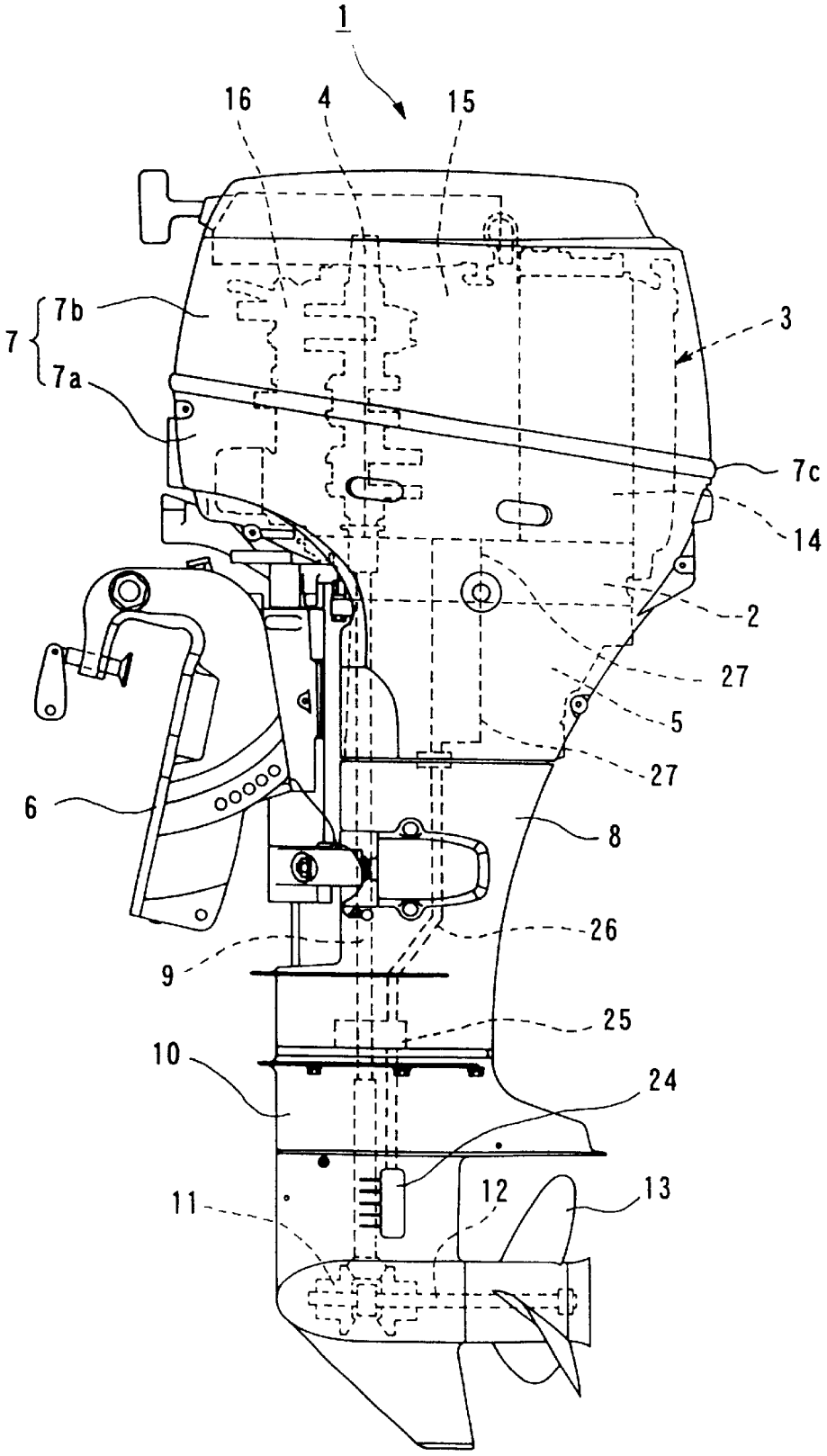
FIG. 1 is a left side view of an outboard motor showing an embodiment of a structure for mounting electrical equipment of the outboard motor of the present invention.

FIG. 1 is a left side view of an outboard motor to which the present invention is applicable, in which the outboard motor is shown in a state to be mounted to a hull or like. As shown in FIG. 1, the outboard motor 1 includes an engine holder 2, and an engine 3 is disposed above the engine holder 2. The engine 3 is a vertical type engine in which a crankshaft 4 is disposed substantially vertically in a crankcase of the engine 3. An oil pan 5 is disposed below the engine holder 2, a bracket 6 is mounted to the engine holder 2, for example, and the outboard motor 1 is mounted to a transom of a hull, not shown, through the bracket 6.

Peripheries of the engine 3, the engine holder 2 and the oil pan 5 of the outboard motor 1 are covered with an engine cover 7. The engine cover 7 is divided into lower and upper two sections, i.e., into a lower cover section 7*a* for covering the peripheries of a lower portion of the engine 3, the engine holder 2 and the oil pan 5 and an upper cover section 7*b* for covering an upper portion of the engine 3.

A drive shaft housing 8 is disposed in a lower portion of the oil pan 5. A drive shaft 9 is disposed substantially vertically in the engine holder 2, the oil pan 5 and the drive shaft housing 8, and an upper end of the drive shaft 9 is connected to a lower end of the crankshaft 4. The drive shaft 9 is extended downward in the drive shaft housing 8 for driving a propeller 13 through a bevel gear 11 and a propeller shaft 12 in a gear case 10 provided in a lower portion of the driving shaft housing 8.

Figure 2:
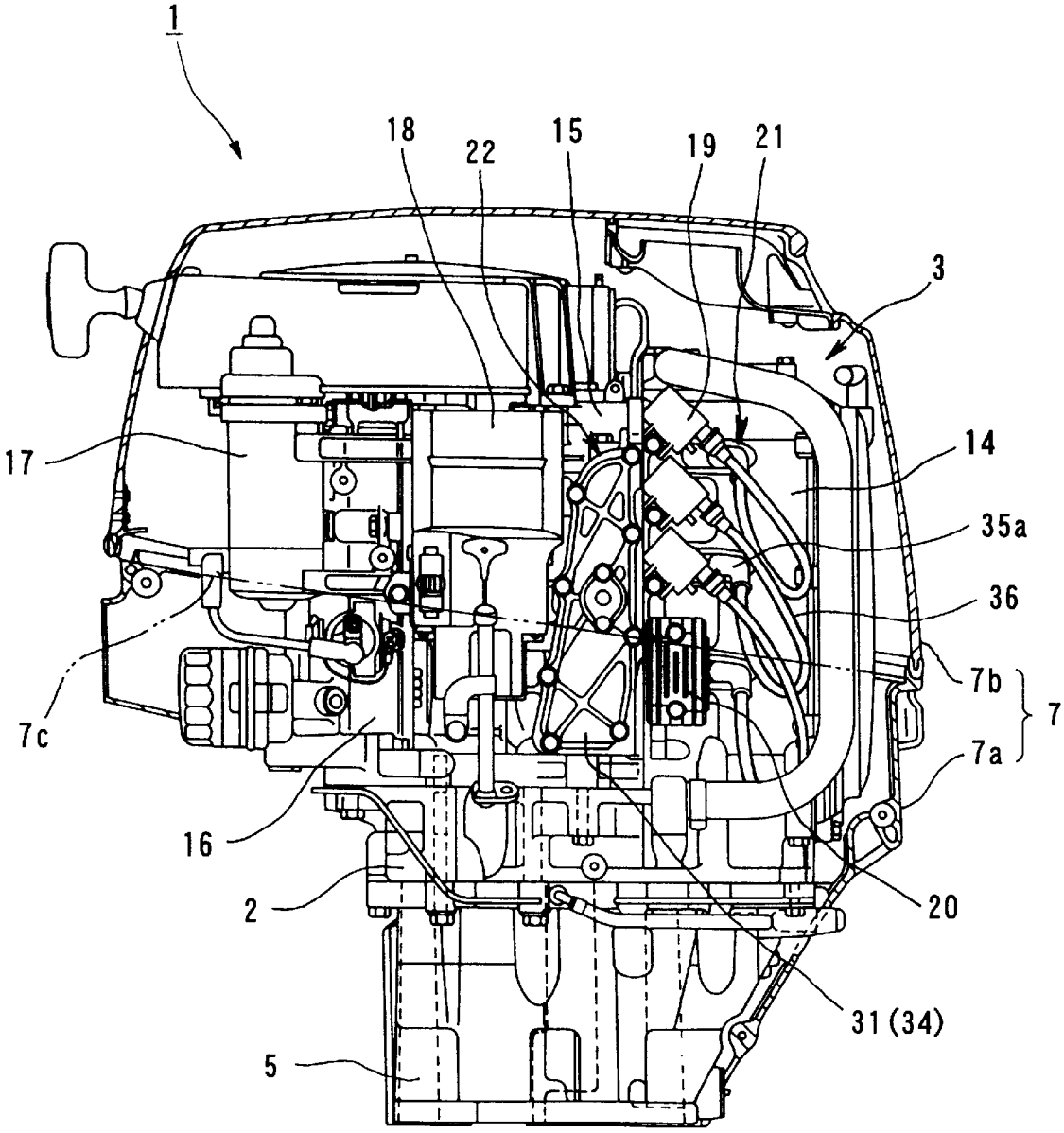
FIG. 2 is an enlarged side view of an engine of the outboard motor shown in FIG.1.
Figure 3:
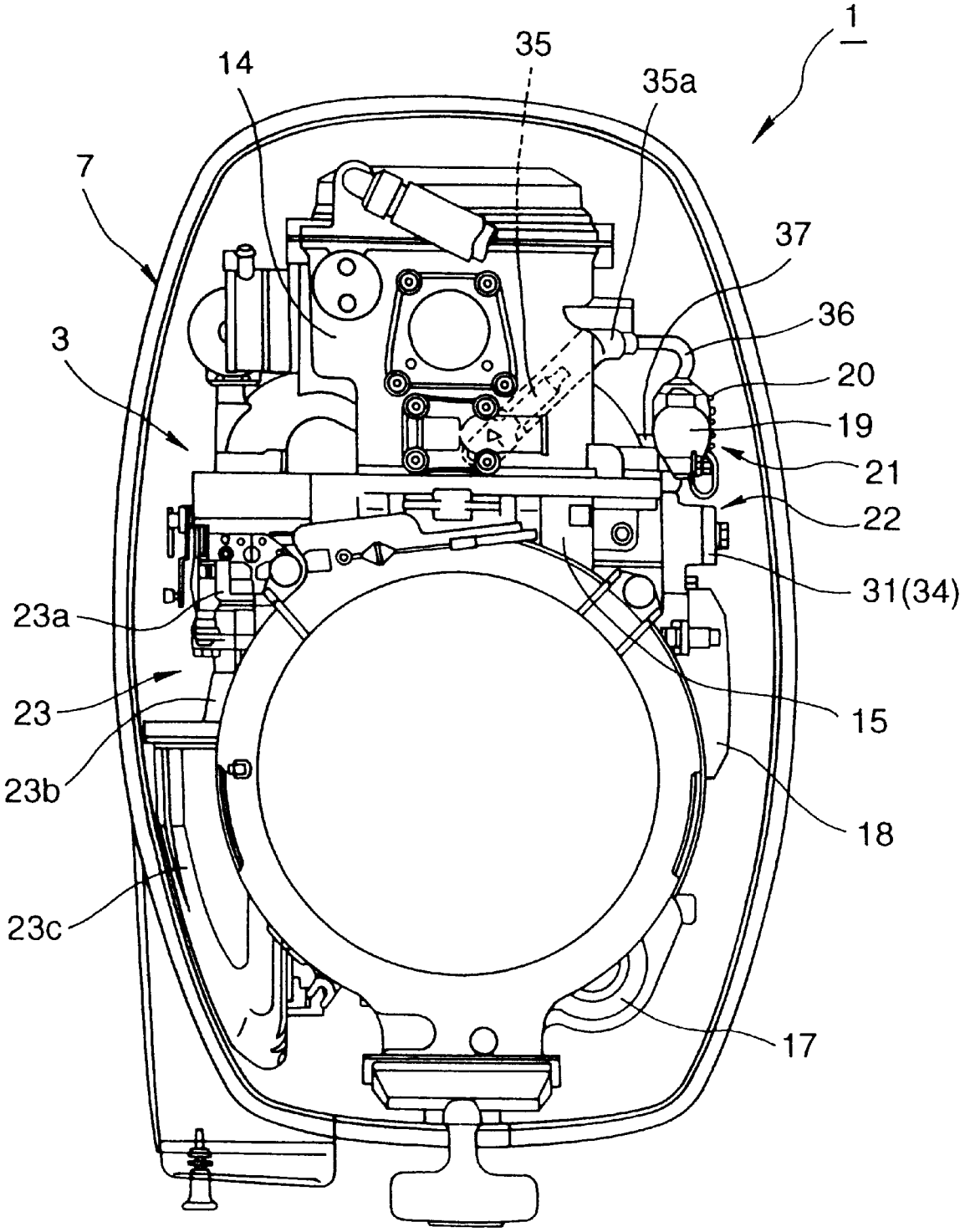
FIG. 3 is a plan view of the engine shown in FIG. 2.

FIG. 2 is an enlarged side view of a portion of the engine 3 of the outboard motor 1 shown in FIG. 1, and FIG. 3 is a plan view of the engine 3. As shown in FIGS. 1, 2 and 3, the engine 3 mounted in the outboard motor 1 is a water-cooled four-stroke-cycle three-cylinder engine comprising a combination of crankcase 16, a cylinder head 14, a cylinder block 15 in this order from a hull (not shown) side when mounted in a vertical usable state.

The cylinder block 15 is disposed at the forefront of the engine 3, i.e., behind (right side) of the crankcase 16 disposed at the leftmost position in FIGS. 1 and 2. The cylinder head 14 is disposed behind the cylinder block 15.

Disposed on the left side surface of the engine 3 are a starter motor 17, an electrical equipment box 18 in which control electrical equipment (not shown) is accommodated, ignition coils 19 in equal numbers to the cylinders (three), electrical equipment parts 21 such as a rectifier and a regulator 20 including a cooling fin 20*a*, and an exhaust system part 22. Disposed on the right side surface of the engine 3 are intake system parts 23 such as a carburetor 23*a*, an intake pipe 23*b* and silencer 23*c*. Among the electrical equipment parts 21, the rectifier and the regulator 20 generating great heat are disposed such that these elements or parts are located below a separating (dividing) surface 7*c* of the engine cover 7 so as to make small a gap formed between them and the lower cover section 7*a*.

Meanwhile, the engine 3 of the outboard motor 1 is of water-cooled type, and as shown in FIG. 1, seawater drawn from a water-intake port 24 provided in the gear case 10 is used as cooling water for cooling the engine 3. The cooling water is drawn from the water-intake port 24 by a water pump 25 which is driven by the drive shaft 9. The cooling water is then introduced into a cooling water passage 27 in the oil pan 5 and in the engine holder 2 through a water pipe 26 and introduced into the engine 3 through the cooling water passage 27.

With reference to FIGS. 4 to 8, an exhaust passage 29 is formed in the cylinder block 15 for connecting an exhaust port 28 formed in the cylinder head 14 and an exhaust gas discharge passage, not shown, in the engine holder 2 to each other. A cooling water jacket 30 for cooling the exhaust passage 29 connected to the cooling water passage 27 in the engine holder 2 is formed around the exhaust passage 29. An opening 30*a* of the cooling water jacket 30 in a side surface of the cylinder block 15 is closed with an exhaust cover 31 constituting the exhaust system parts 22.

A cooling water jacket 32 for cooling a cylinder 15*a* formed in the cylinder block 15 and a cooling water jacket 33 for cooling an exhaust port 28 formed in the cylinder head 14 are provided downstream from the cooling water jacket 30 for cooling the exhaust passage 29.

Figure 7:
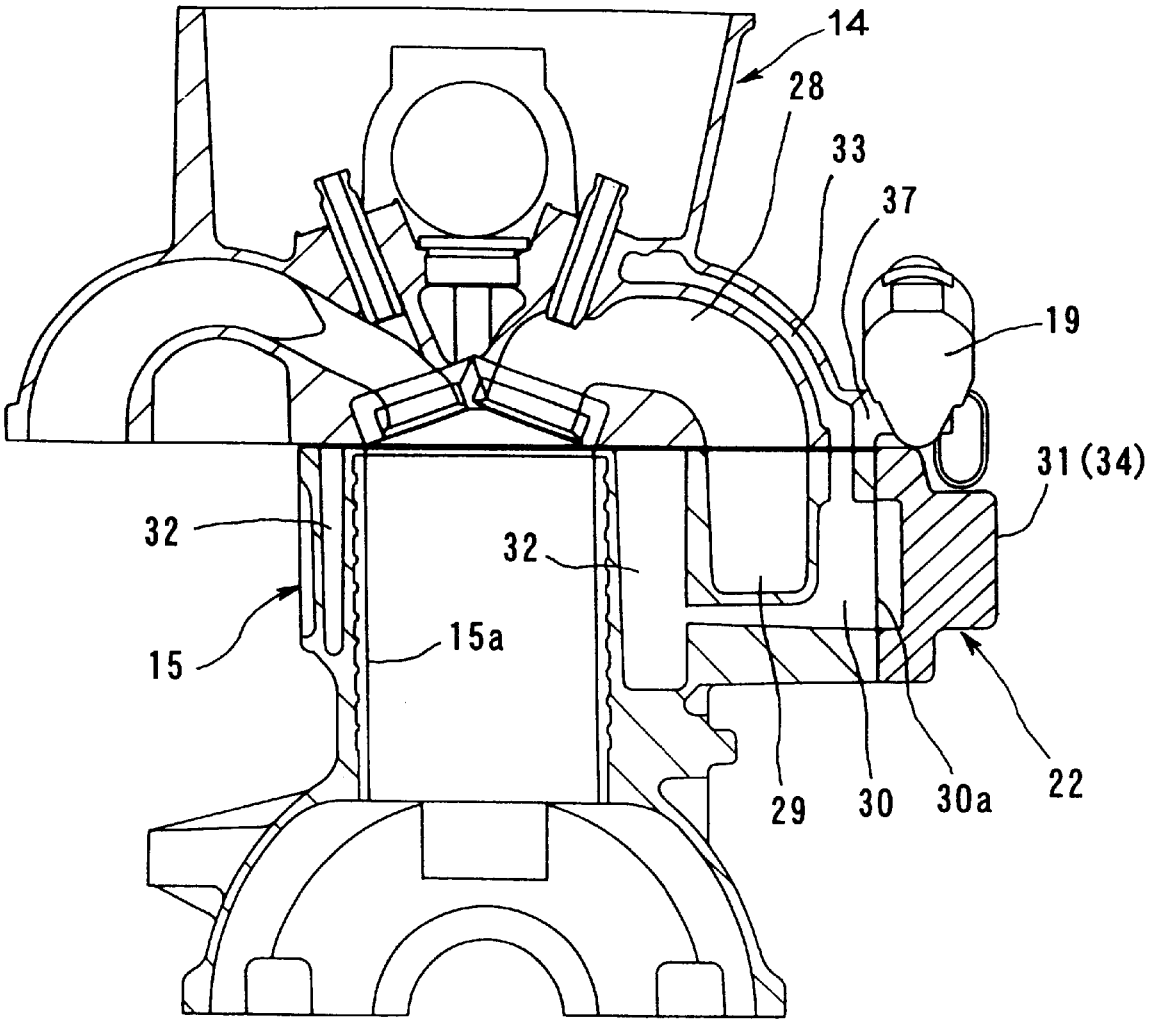
FIG. 7 is a cross sectional view taken along the line VII—VII in FIG. 4 or 5.

As shown in FIGS. 2, 3 and 7, the exhaust cover 31 (exhaust system part 22) for closing the cooling water jacket 30 for cooling the exhaust passage 29 projects sideways of the engine 3 and forms an exhaust system projecting portion 34. The projecting portion 34 extends vertically at substantially the central portion of the side surface of the engine 3 as shown in FIG. 2.

A space is defined between a body of the engine and the engine cover 7, and the electrical equipment box 18 is disposed in a portion of the space formed on a side closer to the cylinder block 15. In a portion of the space formed on the cylinder head side, the electrical equipment parts 21 comprising the ignition coil 19, the rectifier and the regulator 20 are disposed between an ignition plug 35 (see FIG. 3) connected to the cylinder head 14 and the projecting portion 34. Further, a plug cap 35*a* of the ignition plug 35 and the ignition coil 19 are connected to each other through a high-tension cord 36.

That is, in the conventional structure, the exhaust system including, for example, the exhaust passage 29 is arranged with relatively sharp angle. In order to improve this layout, the projected (projection) portion 34 is formed in which the exhaust system is incorporated, and to this projecting portion 34, the electrical equipment parts 21 are arranged. Thus, the engine structure is enlarged in width. However, according to the location of such projecting portion 34, the extra (dead) space is formed between the engine cover and the engine body, in which conventionally no equipment is arranged. The present invention utilizes such space for arranging the electrical equipment parts 21 therein, i.e. a space defined by the cylinder head 14, the projecting portion 34 and the engine cover 7.

Figure 9:
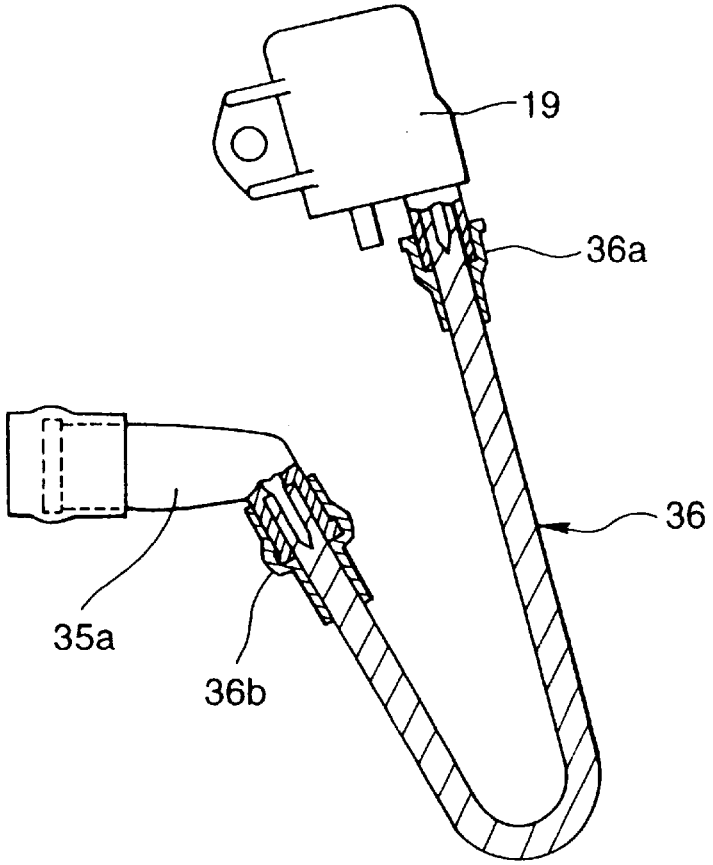
FIG. 9 is an enlarged side view of an ignition coil, a plug cap and a high-tension cord.

FIG. 9 is an enlarged side view of the ignition coil 19, the plug cap 35*a* and the high-tension cord 36. As shown in FIGS. 2 and 9, the ignition coil 19, the plug cap 35*a* and the high-tension cord 36 are disposed while avoiding a mounting space of the ignition plug 35. More specifically, a connection portion 36*a* between the ignition coil 19 and the high-tension cord 36, and a connection portion 36*b* between the plug cap 35*a* and the high-tension cord 36 are disposed in a rear and obliquely downward direction.

Figure 4:
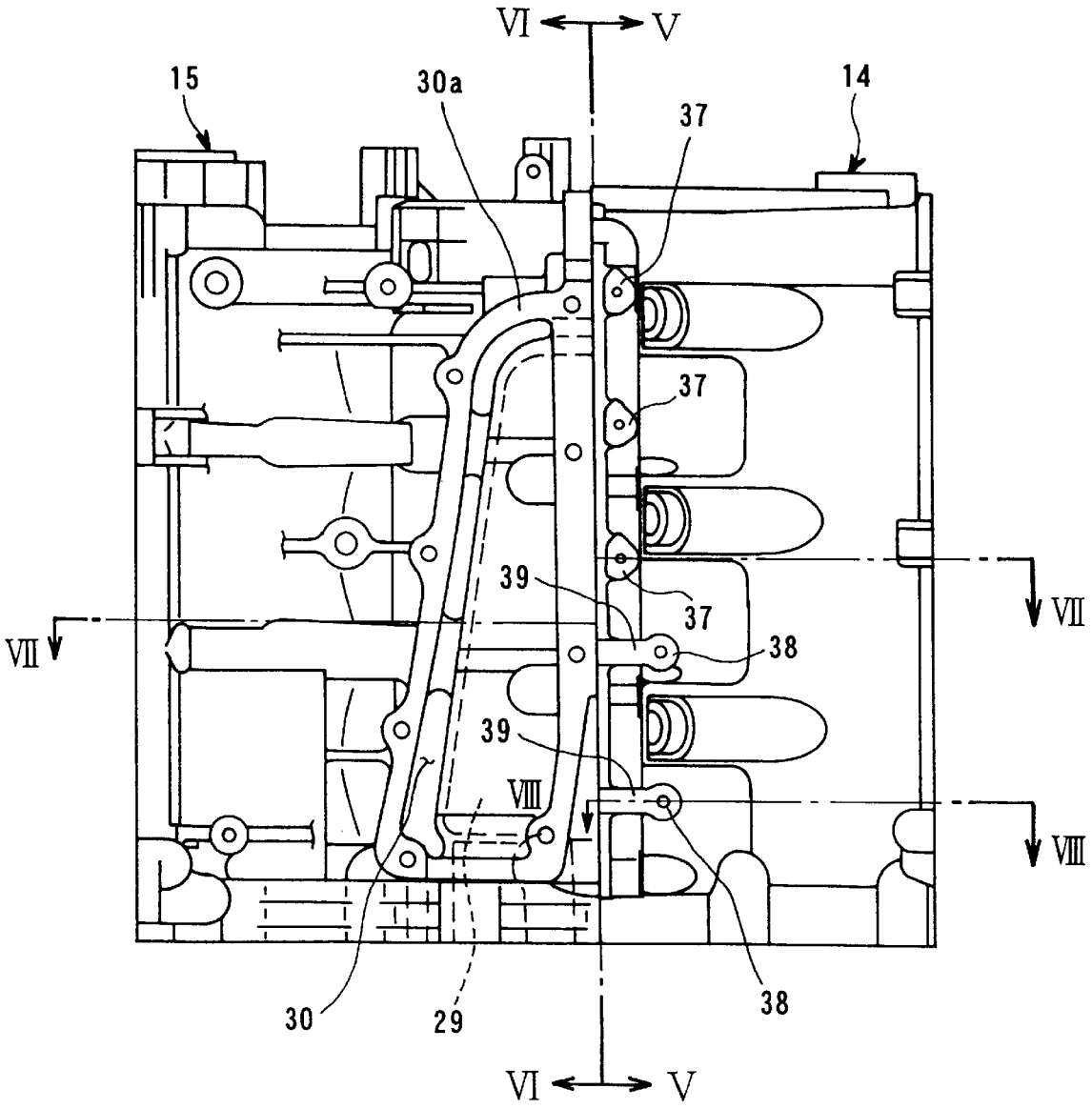
FIG. 4 is a left side view of a cylinder head and a cylinder block of the engine of FIG. 2.
Figure 5:
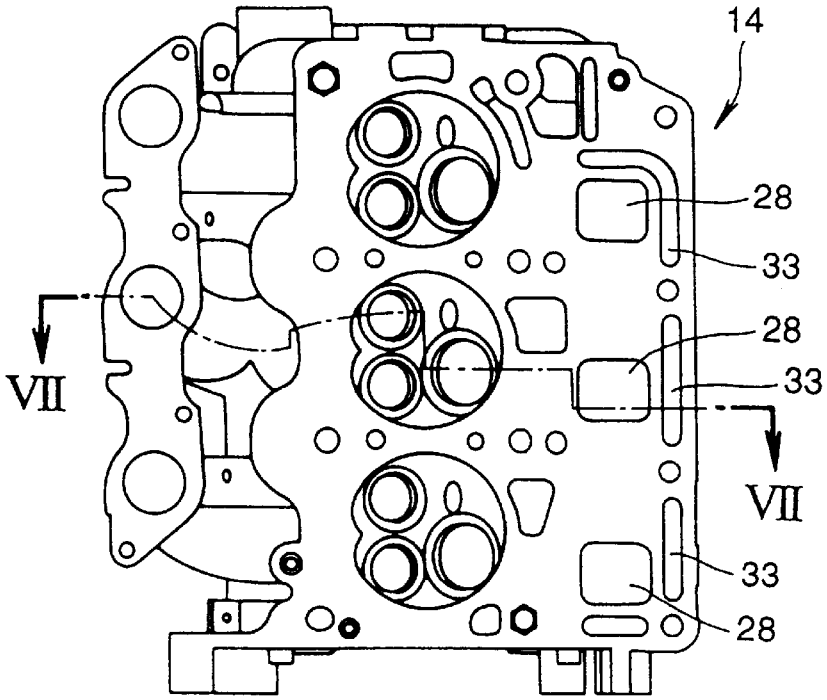
FIG. 5 is a view viewed from an arrow V in FIG. 4 (front view of the cylinder head)
Figure 6:
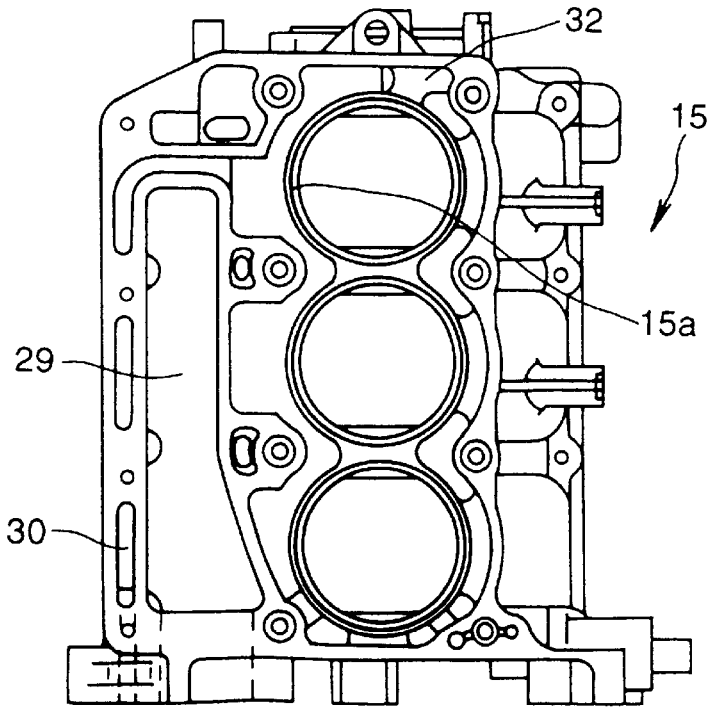
FIG. 6 is a view viewed from an arrow VI in FIG. 4 (rear view of the cylinder block)
Figure 8:
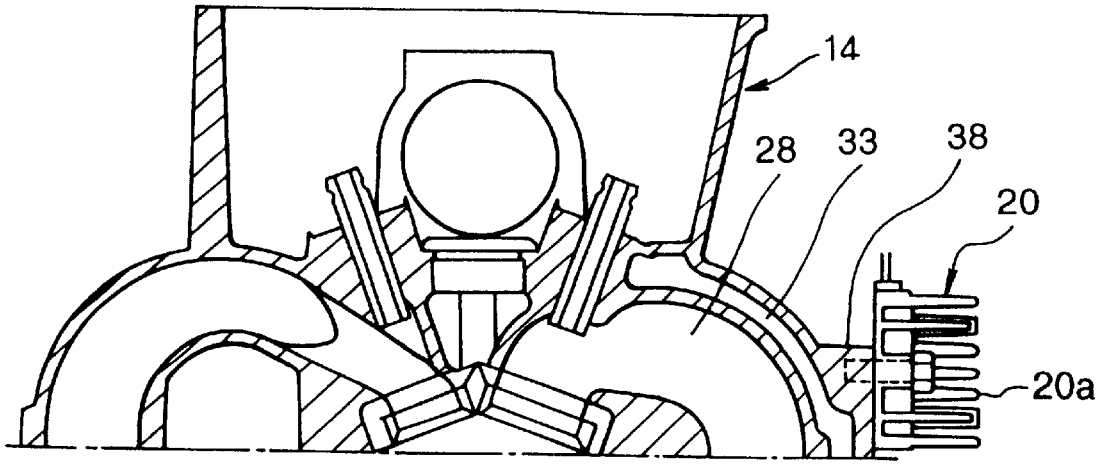
FIG. 8 is a cross sectional view taken along the line VIII—VIII in FIG. 4.

As shown in FIGS. 4, 7 and 8, bosses 37 and 38 for mounting the electrical equipment parts 21 comprising the ignition coil 19, the rectifier and the regulator 20 are integrally formed on a side surface of the cylinder head 14. The bosses 37 and 38 are disposed in the vicinity of the cooling water jacket 33 for cooling the exhaust port 28. The boss 38 for mounting the rectifier and the regulator 20 for example has a contact surface 39 contacting with the rectifier and the regulator 20 as wide as possible.

Then, the operation of the present embodiment will be described hereunder.

In the portion of the space formed on the cylinder head side, the electrical equipment parts 21 comprising the ignition coil 19, the rectifier and the regulator 20 are disposed between an ignition plug 35 (see FIG. 3) connected to the cylinder head 14 and the projecting portion 34 formed by the exhaust (system) parts 22. According to this layout, a dead space, which was not used in the conventional layout, can be utilized effectively, and the outboard motor 1 can be made compact without increasing the lateral width of the engine 3.

Further, since the ignition coil 19 and the ignition plug 35 are disposed in the same space, the high-tension cord 36 can be shortened, the ignition performance (increase of energizing energy) can be enhanced, an outer appearance can be improved, and a generation of noise can be reduced. Moreover, since the high-tension cord 36 does not straddle the projecting portion 34, the lateral width of the engine 3 is not widened.

Further, it may be possible to unify the length of the high-tension cord 36, thereby reducing the number of kinds of parts and costs.

Meanwhile, if the high-tension cord 36 for connecting the plug cap 35*a* of the ignition plug 35 and the ignition coil 19 is disposed horizontally rearward, it is impossible to design the engine so as to make narrow the rear portion of the engine cover 7 to make compact the engine. If the high-tension cord 36 is disposed downward, it is difficult to dispose a plurality of ignition coils 19.

Then, as described above, since the connection portion 36*a* between the ignition coil 19 and the high-tension cord 36 and the connection portion 36*b* between the plug cap 35*a* and the high-tension cord 36 are disposed in a rear and obliquely downward direction, no part exists in a mounting direction of the ignition plug 35, and the mounting performance of the ignition plug 35 and the plug cap 35*a* can be enhanced. Furthermore, even if any one of the ignition coil 19, the plug cap 35*a* and the high-tension cord 36 be caused to be wet, the water drop is less prone to reach the connection portions 36*a* and 36*b*.

Furthermore, since the electrical equipment part 21 is disposed in the space formed on the side surface closer to the cylinder head 14 with the exhaust system projecting portion 34 being interposed, another electrical equipment part can be disposed in the space formed on the side surface closer to the cylinder block 15. It is also possible to dispose the electrical equipment box 18 in which the control (system) electrical equipment is accommodated away from a source of noise (such as ignition coil 19 and high-tension cord 36), which is advantageous for reducing the noise, and the heat conduction to the control electrical equipment can be prevented.

Still further, since the rectifier and the regulator 20 which are the electrical equipment part 21 generating great heat are disposed to be located below the separating (dividing) surface 7*c* of the engine cover 7 and the gap between them and the lower cover section 7*a* can be made small, it is possible to prevent a user from touching, thus being not necessary to locate parts or element such as a touch-preventing cover and a display label.

On the other hand, the contact surface 39 of the bosses 37 and 38 contacting the electrical equipment parts 21 is secured as wide as possible. The cooling water jacket for cooling the exhaust port 28 is disposed in the vicinity of the bosses 37 and 38 to introduce the cooling water. According to such layout, it is possible to prevent the electrical equipment part 21 from being heated.

That is, since the electrical equipment part 21 can be cooled indirectly by the cooling water, the cooling efficiency can be enhanced as compared with an air-cooling system, the cooling fin 20*a* and the like can be made compact, the electrical equipment part 21 can be reduced in size and weight, and the flexibility and reliability in layout is also enhanced. Further, it is possible to prevent the temperature of the air in the engine cover 7 from rising.

It is to be noted that the present invention is not limited to the described embodiment and many other changes and modifications may be made without departing from the scopes of the appended claims.

What is claimed is:

1. An outboard motor comprising:

an engine holder;

an engine disposed above the engine holder in a mounted usable state of the outboard motor;

an oil pan disposed below the engine holder; and an engine cover configured to cover the engine holder, the engine and the oil pan so as to define a space between the engine and the engine cover, said engine including a crankcase in which a crankshaft extends vertically perpendicularly;

a cylinder block disposed on a rear side of the crankcase;

a cylinder head disposed on a rear side of the cylinder block;

an intake unit disposed on one side surface of the engine;

an exhaust unit disposed on another side surface thereof, said exhaust unit being arranged so as to project outwardly from the other side surface of the engine as an exhaust projection portion; and an electrical equipment part;

wherein said space between the engine and the engine cover includes a space portion defined by the cylinder head, the exhaust projection portion and the engine cover;

wherein said electrical equipment part is disposed in said space portion; and wherein an ignition plug is disposed on the cylinder head so as to define said space portion between the ignition plug and the exhaust projection portion in which an ignition coil is arranged.

2. An outboard motor according to claim 1, wherein said ignition coil is disposed in a vertical direction, said ignition plug includes a plug cap which is connected to the ignition coil through a high-tension cord so that a first connected portion between the ignition coil and the high-tension cord and a second connected portion between the plug cap and the high-tension cord are disposed in a rear and obliquely downward direction.

3. An outboard motor according to claim 1, wherein a boss for mounting the electrical equipment part is integrally formed with the cylinder head.

4. An outboard motor according to claim 3, wherein a cooling water jacket is formed with the cylinder head in a vicinity of said boss.

5. An outboard motor comprising:

an engine holder;

an engine disposed above the engine holder in a mounted usable state of the outboard motor;

an oil pan disposed below the engine holder; and an engine cover configured to cover the engine holder, the engine and the oil pan so as to define a space between the engine and the engine cover, said engine including a crankcase in which a crankshaft extends vertically perpendicularly;

a cylinder block disposed on a rear side of the crankcase;

a cylinder head disposed on a rear side of the cylinder block;

an intake unit disposed on one side surface of the engine;

an exhaust unit disposed on another side surface thereof, said exhaust unit being arranged so as to project outwardly from the other side surface of the engine as an exhaust projection portion; and an electrical equipment part;

wherein said space between the engine and the engine cover includes a space portion defined by the cylinder head, the exhaust projection portion and the engine cover;

wherein said electrical equipment part is disposed in said space portion; and wherein said engine cover includes upper and lower cover sections in the vertical usable state of the outboard motor and said electrical equipment part includes an electrical element generating heat, said electrical heat generating element being located below a dividing portion of the engine cover.

* * * * *